US011806605B2

(12) United States Patent
Indulti

(10) Patent No.: US 11,806,605 B2
(45) Date of Patent: Nov. 7, 2023

(54) TOE-PIECE OF A SKI BINDING FOR SKI MOUNTAINEERING

(71) Applicant: ATK SPORTS S.r.l., Fiorano Modenese (IT)

(72) Inventor: Davide Indulti, Fiorano Modenese (IT)

(73) Assignee: ATK SPORTS S.r.l., Fiorano Modenese (IT)

( * ) Notice: Subject to any disclaimer, the term of this patent is extended or adjusted under 35 U.S.C. 154(b) by 0 days.

(21) Appl. No.: 17/861,953

(22) Filed: Jul. 11, 2022

(65) Prior Publication Data

US 2023/0016853 A1 Jan. 19, 2023

(30) Foreign Application Priority Data

Jul. 13, 2021 (IT) ..... 102021000018380

(51) Int. Cl.
*A63C 9/085* (2012.01)

(52) U.S. Cl.
CPC ..... *A63C 9/0855* (2013.01); *A63C 9/08542* (2013.01)

(58) Field of Classification Search
CPC ..... A63C 9/0855; A63C 9/08542; A63C 9/08528; A63C 9/08564; A63C 9/086; A63C 9/0807
See application file for complete search history.

(56) References Cited

U.S. PATENT DOCUMENTS 3,194,573 A * 7/1965 Unger ..... A63C 9/0855 280/626
3,689,095 A * 9/1972 Salomon ..... A63C 9/0845 280/628
3,897,075 A * 7/1975 Cutter ..... A63C 9/0855 280/626
4,298,213 A * 11/1981 Storandt ..... A63C 9/08564 280/628
4,577,887 A * 3/1986 Bardin ..... A63C 9/08571 280/628
5,879,020 A * 3/1999 Buquet ..... A63C 9/0842 280/634
9,526,973 B2 * 12/2016 Ibach ..... A63C 9/22
11,491,388 B2 * 11/2022 Soldan ..... A63C 9/08578

FOREIGN PATENT DOCUMENTS

EP 2659940 A1 * 11/2013 ..... A63C 9/0807

* cited by examiner

*Primary Examiner* — James A Shriver, II
*Assistant Examiner* — Michael T. Walsh
(74) *Attorney, Agent, or Firm* — R. Neil Sudol; Henry D. Coleman

(57) ABSTRACT

A toe-piece of a ski binding for ski mountaineering has a base, a first jaw, a second jaw, an activating lever, a joint, a housing, and elastic means. The first jaw is provided with a first guide, and the second jaw is provided with a second guide. The activating lever is rotatably coupled to the base. The joint is activatable by the activating lever, which includes a first sliding element slidably coupled with the first guide and a second sliding element slidably coupled with the second guide, so that the activation of the activating lever causes, via the joint, the rotation of the first jaw and the second jaw. The housing is borne by the base. The elastic means are arranged in the housing so as to push the joint to wedge against the first jaw and the second jaw.

6 Claims, 17 Drawing Sheets

TOE-PIECE OF A SKI BINDING FOR SKI MOUNTAINEERING

FIELD OF THE INVENTION

The present invention relates to the technical sector of ski bindings for ski mountaineering, with particular reference to a toe-piece of a ski binding for ski mountaineering.

DESCRIPTION OF THE PRIOR ART

EP 2659940 describes a toe-piece of a ski binding for ski mountaineering which comprises: a base fixed to a ski; a first jaw which rotatably couples with the base with respect to a first axis of rotation which is parallel to the longitudinal axis of the ski, and which is provided with a first guide which extends in a first oblique direction with respect to the first axis of rotation; a second jaw which rotatably couples with the base with respect to a second axis of rotation which is parallel to the longitudinal axis of the ski, which is provided with a second guide which extends in a second oblique direction with respect to the second axis of rotation; a first pin which is borne by the first jaw for inserting in a first lateral hole made in a tip of a ski boot; a second pin which is borne by the second jaw for inserting in a second lateral hole made in the tip of a ski boot; an activating lever which is rotatably coupled to the base, with respect to a third axis of rotation that is perpendicular to the longitudinal axis of the ski, and which is preferably provided with a fork element comprising a first prong and a second prong; a joint which is arranged between the two prongs in order to be slidably borne by the activating lever, which comprises a first sliding element which slidably couples with the first guide and which comprises a second sliding element which slidably couples with the second guide, so that the activation of the activating lever causes, by means of the joint, the rotation of the first jaw and the second jaw; a spring which is interposed between the activating lever and the joint so as to push the joint to wedge against the first jaw and the second jaw.

The spring has an extension in length which is limited by the position of the third axis of rotation of the activating lever. Further, the spring is located in a position in which it is complicated to make (usually by means of a screw) an adjustment of the preload thereof.

BRIEF SUMMARY OF THE INVENTION

The aim of the present invention consists in obviating the above-mentioned drawbacks.

A toe-piece of a ski binding for ski mountaineering comprises, in accordance with the present invention, a base fixable to a ski, a first jaw, a second jaw, an activating lever, a joint, a housing, and elastic means. The first jaw rotatably couples with the base with respect to a first axis of rotation. The first jaw is provided with a first guide that extends in a first oblique direction with respect to the first axis of rotation. The second jaw rotatably couples with the base with respect to a second axis of rotation and is provided with a second guide that extends in a second oblique direction with respect to the second axis of rotation. A first pin is borne by the first jaw for inserting in a first lateral hole made in a tip of a ski boot. A second pin is borne by the second jaw for inserting in a second lateral hole in the tip of the ski boot. The activating lever is rotatably coupled to the base. The joint is activatable by the activating lever and comprises a first sliding element, which slidably couples with the first guide, and a second sliding element, which slidably couples with the second guide, so that the activation of the activating lever causes, by means of the joint, a rotation of the first jaw and the second jaw. The elastic means are arranged so as to push the joint to wedge against the first jaw and the second jaw. A housing is borne by the base, the elastic means being arranged in the housing.

The elastic means (for example a spring) are advantageously arranged in a housing borne by the base, which allows greater liberty in terms of the size and adjustment of the preload.

BRIEF DESCRIPTION OF THE DRAWINGS

Specific embodiments of the invention will be described in the following part of the present description, according to what is set down in the claims and with the aid of the accompanying tables of drawings, in which:

DESCRIPTION OF THE PREFERRED EMBODIMENTS

Figure 1:
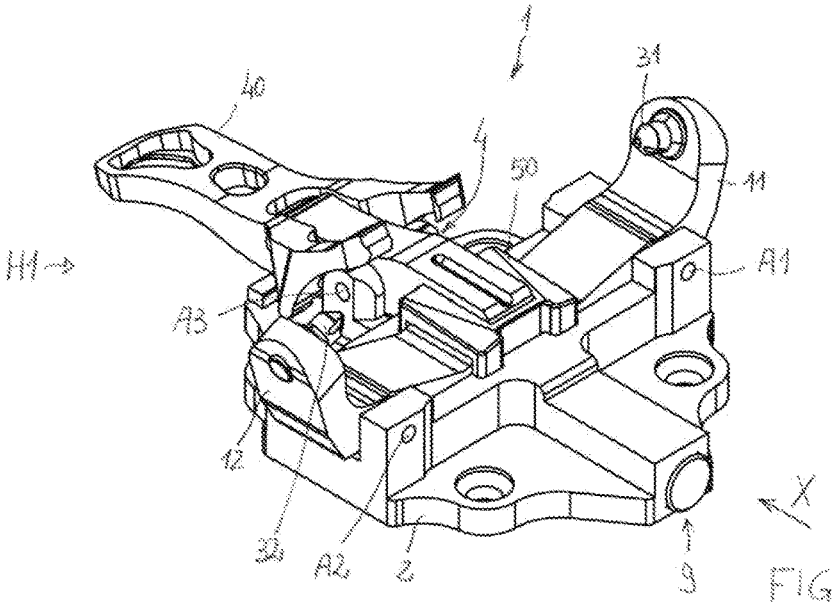
FIG. 1 is a perspective view of the toe-piece of the ski binding for ski mountaineering, object of the present invention and according to a first embodiment of the invention, in a configuration ready to receive a ski boot.

With reference to the appended tables of drawings, reference numeral (1) denotes in its entirety a toe-piece of the ski binding for ski mountaineering according to the present invention, comprising: a base (2) which is fixable to a ski (not illustrated); a first jaw (11) which rotatably couples with the base (2) with respect to the first axis of rotation (A1) (FIGS. 1, 4, 5 for example), which is provided with a first guide (21) which extends in a first oblique direction (B1) (see for example FIG. 6) with respect to the first axis of rotation (A1); a second jaw (12) which rotatably couples with the base (2) with respect to a second axis of rotation (A2) and which is provided with a second guide (22) which extends in a second oblique direction (B2) (see for example FIG. 6) with respect to the second axis of rotation (A2); a first pin (31) which is borne by the first jaw (11) for inserting in a first lateral hole (41) made in a tip of a ski boot (3); a second pin (32) which is borne by the second jaw (12) for inserting in a second lateral hole (42) made in the tip of the ski boot (3); an activating lever (4) which is rotatably coupled to the base (2); a joint (5) which is activatable by the activating lever (4), which comprises a first sliding element (51) which slidably couples with the first guide (21) and which comprises a second sliding element (52) which slidably couples with the second guide (22 (FIG. 4A for example), so that the activation of the activating lever (4) causes, by means of the joint (5), the rotation of the first jaw (11) and the second jaw (12); a housing (6) borne by the base (2); elastic means (7) which are arranged so as to push the joint (5) to wedge against the first jaw (11) and the second jaw (12) and which are arranged in the housing (6).

Figure 4A:
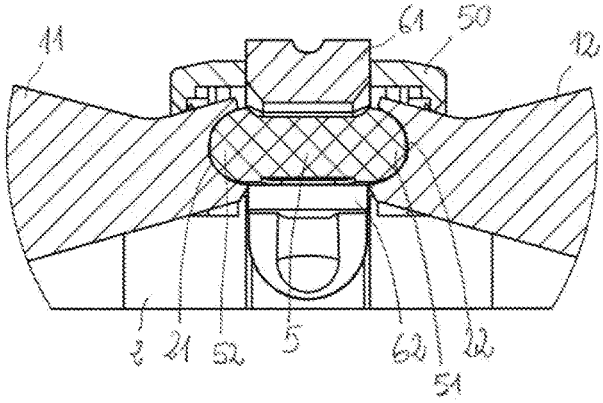
FIG. 4A is a larger-scale view of detail K2 of FIG. 4.
Figure 4:
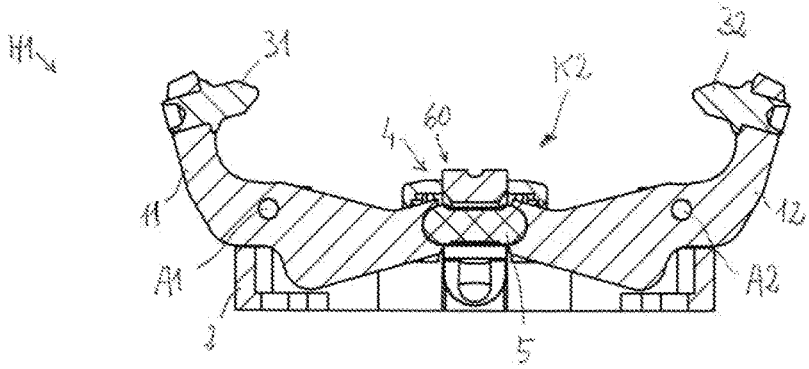
FIG. 4 is a view of section IV-IV of FIG. 2.
Figure 5:
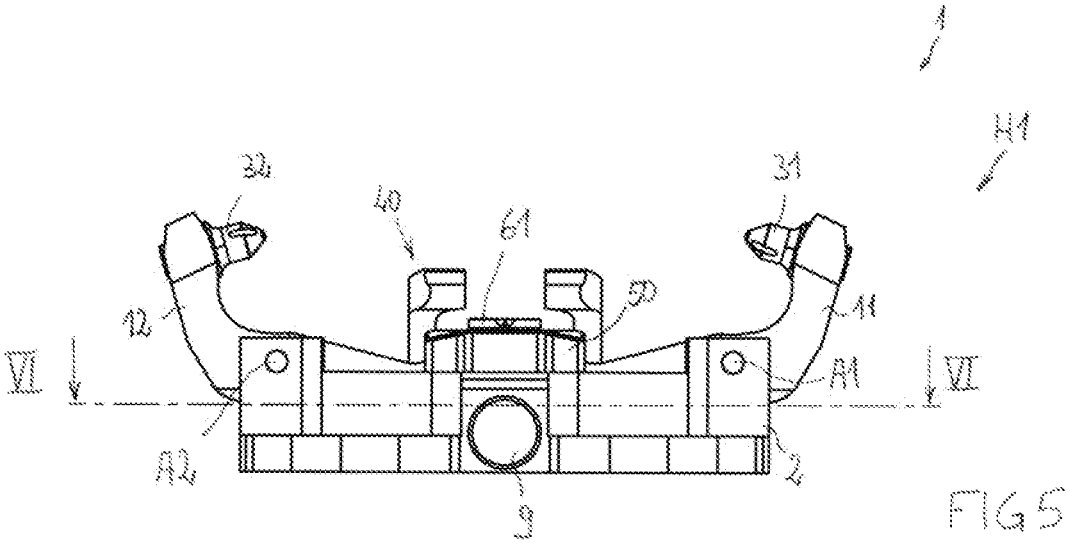
FIG. 5 is a frontal view of the toe-piece of the ski binding of FIG. 1, according to view "X" indicated in FIG. 1.

The first sliding element (51) and the second sliding element (52) can be an integral part of the joint (5), see for example FIG. 4A.

The first jaw (11) preferably couples by means of a revolute pair (one only degree of freedom) to the base (2) with respect to the first axis of rotation.

The second jaw (12) preferably couples by means of a revolute pair (one only degree of freedom) with the base (2) with respect to the second axis of rotation (A2).

The joint (5) is preferably borne by the first guide (21) and by the second guide (22), see for example FIG. 4A.

Figure 2:
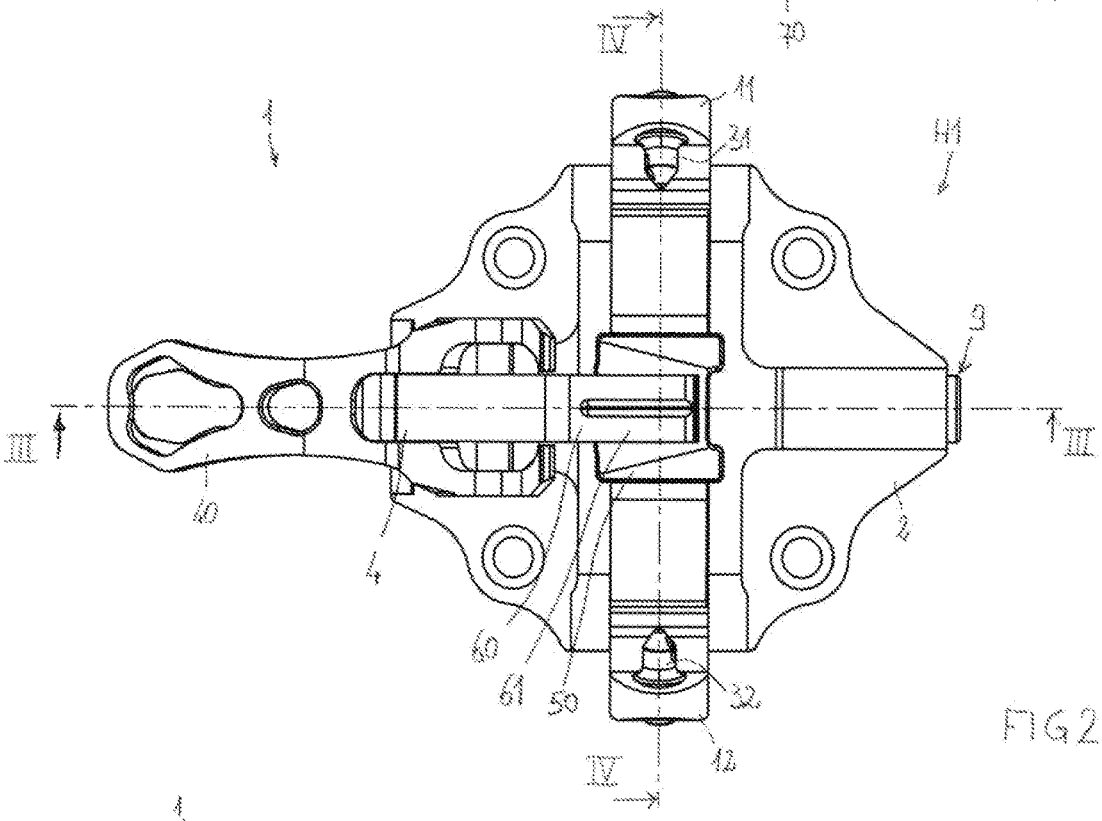
FIG. 2 is a view from above of the toe-piece of the ski binding of FIG. 1.
Figure 8:
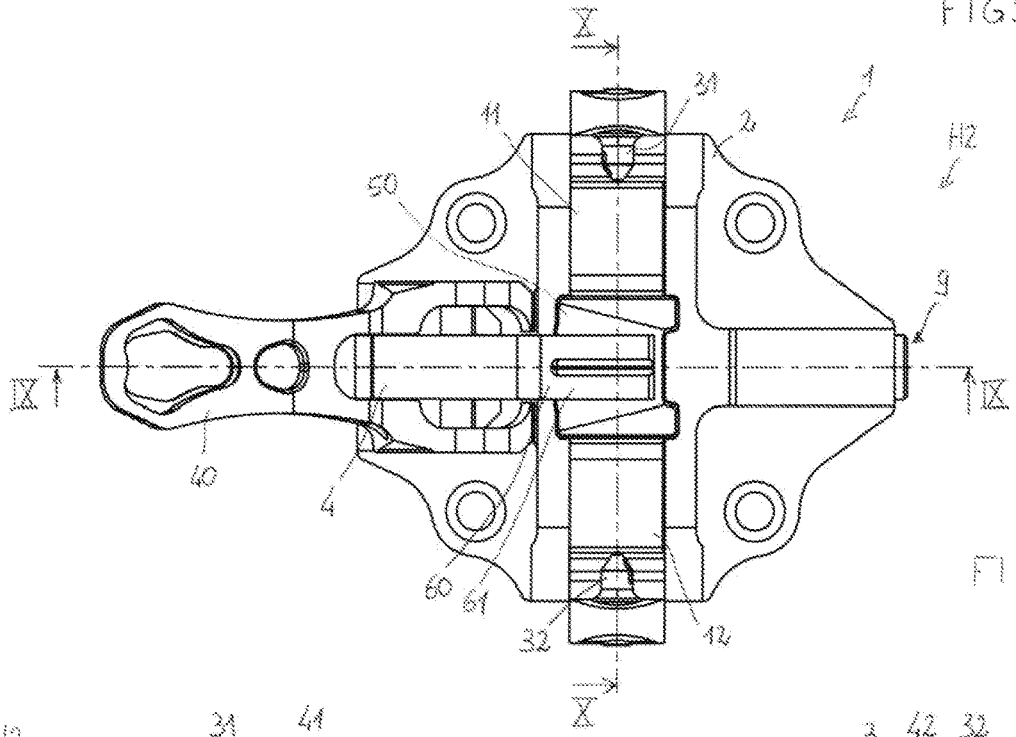
FIG. 8 is a view from above of the toe-piece of the ski binding of FIG. 7.
Figure 10:
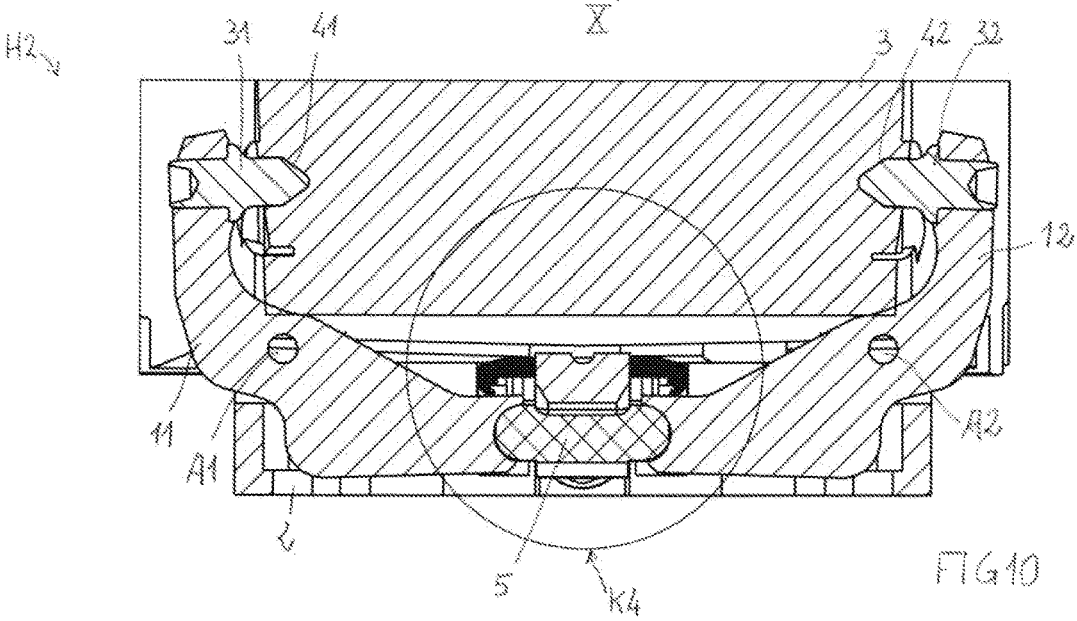
FIG. 10 is a view of section X-X of FIG. 8, in which the ski boot is further illustrated.
Figure 11:
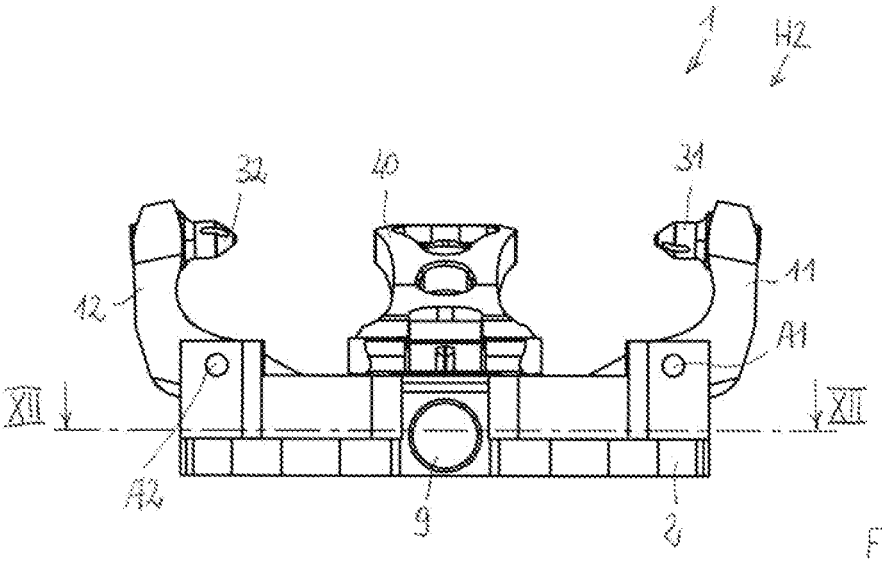
FIG. 11 is a frontal view of the toe-piece of the ski binding of FIG. 7, according to view "X" indicated in FIG. 7.
Figure 12:
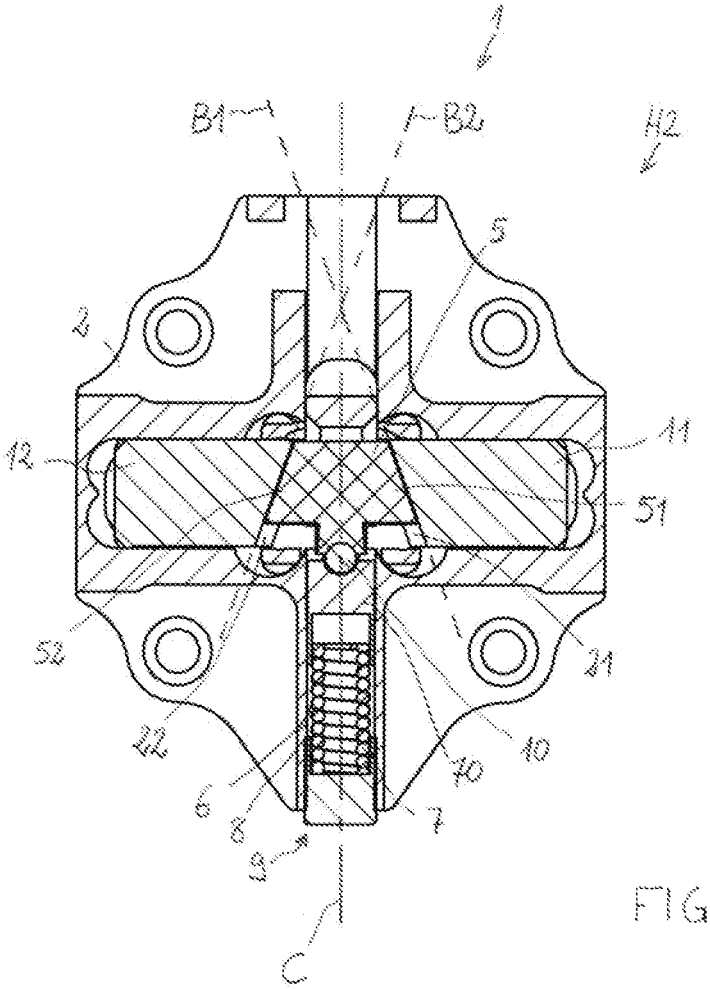
FIG. 12 is a view of section XII-XII of FIG. 11.
Figure 13:
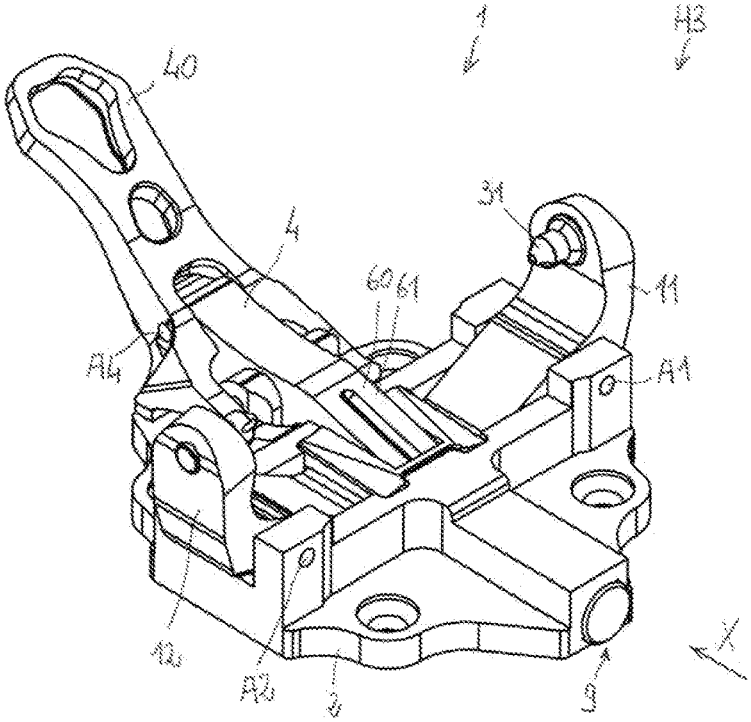
FIG. 13 is a perspective view of the toe-piece of the ski binding of FIG. 1, in a ski ascent configuration, which enables the skier to ski uphill.
Figure 14:
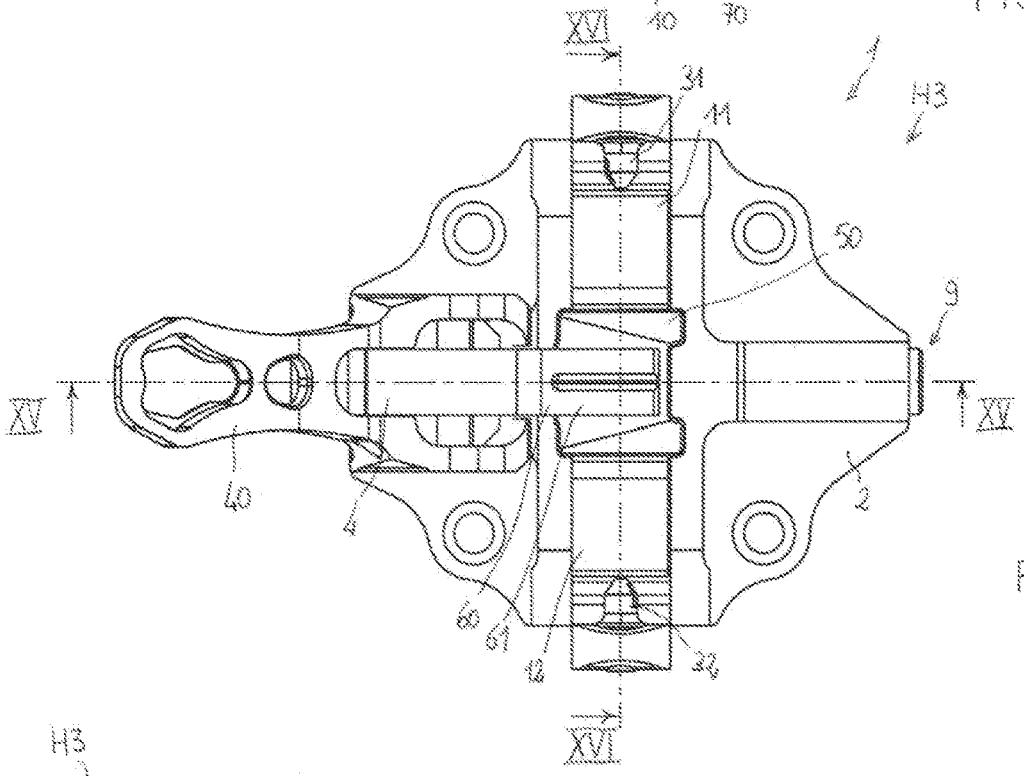
FIG. 14 is a view from above of the toe-piece of the ski binding of FIG. 13.
Figure 16:
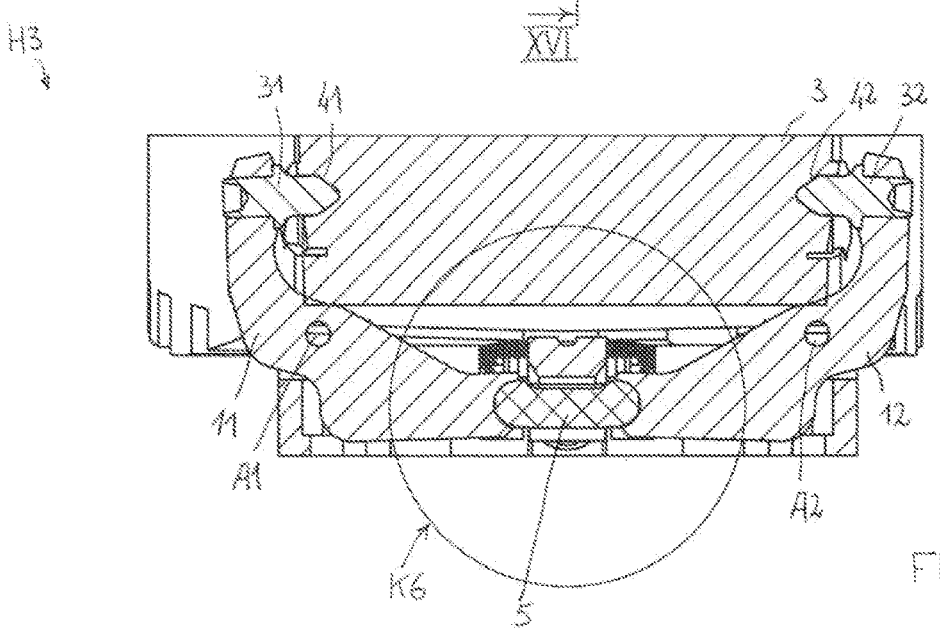
FIG. 16 is a view of section XVI-XVI of FIG. 14, in which the ski boot is further illustrated.
Figure 17:
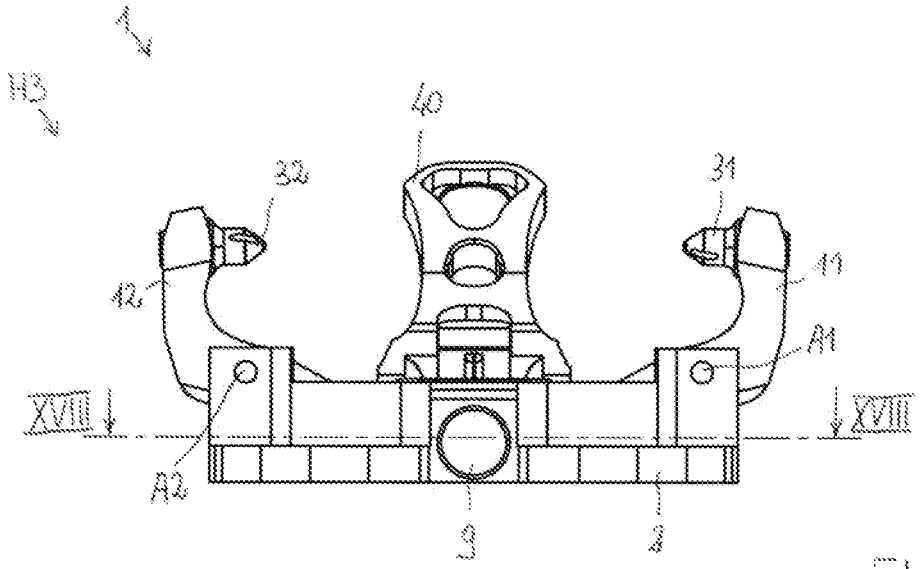
FIG. 17 is a frontal view of the toe-piece of the ski binding of FIG. 13, according to view "X" indicated in FIG. 13.
Figure 18:
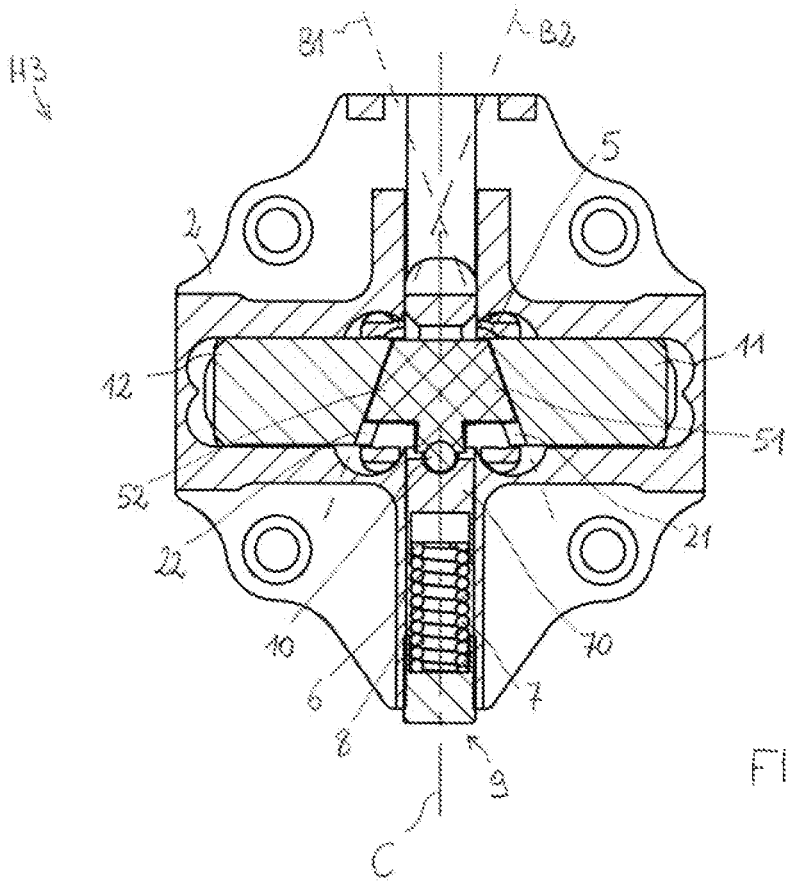
FIG. 18 is a view of section XVIII-XVIII of FIG. 17.

The first axis of rotation (A1) is preferably parallel to the longitudinal axis of the ski (C) (illustrated by way of example in FIGS. 6, 12, 18 and coinciding with section line III-III in FIG. 2, with section line IX-IX in FIG. 8, and with section line XV-XV in FIG. 14) when the base (2) is fixed to the ski.

The second axis of rotation (A2) is preferably parallel to the longitudinal axis of the ski (C) when the base (2) is fixed to the ski.

Figure 6:
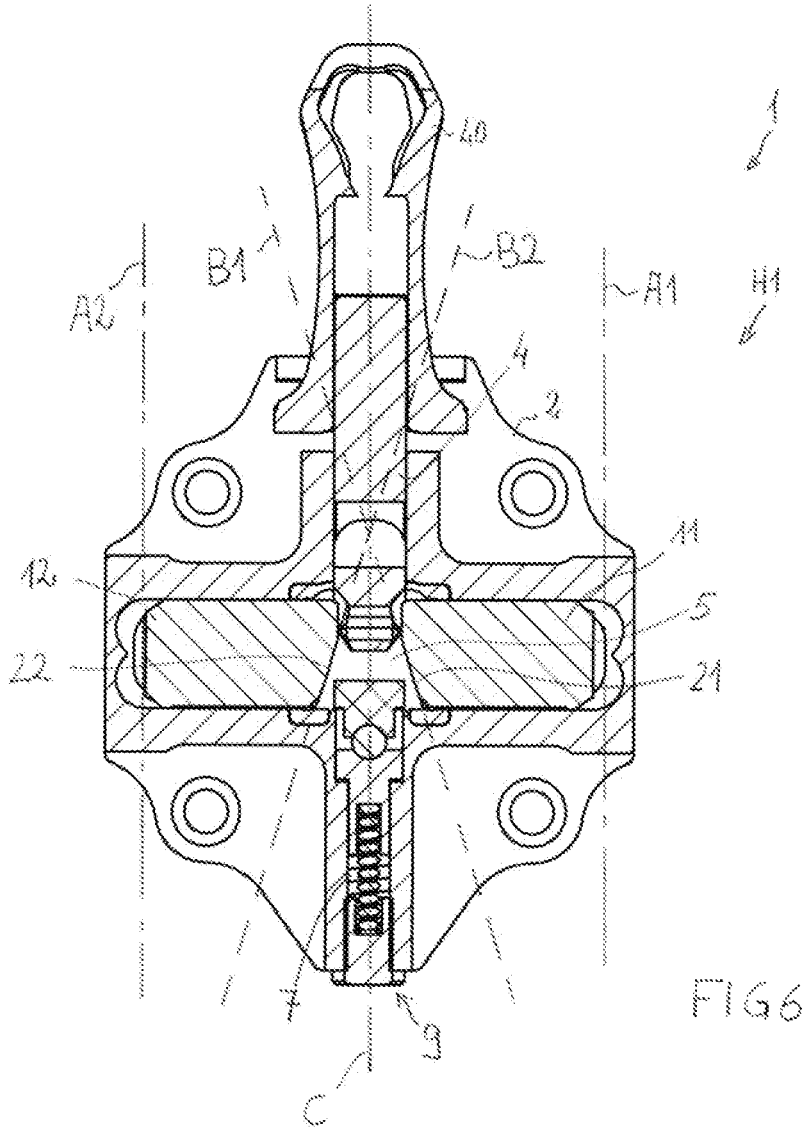
FIG. 6 is a view of section VI-VI of FIG. 5.
Figure 7:
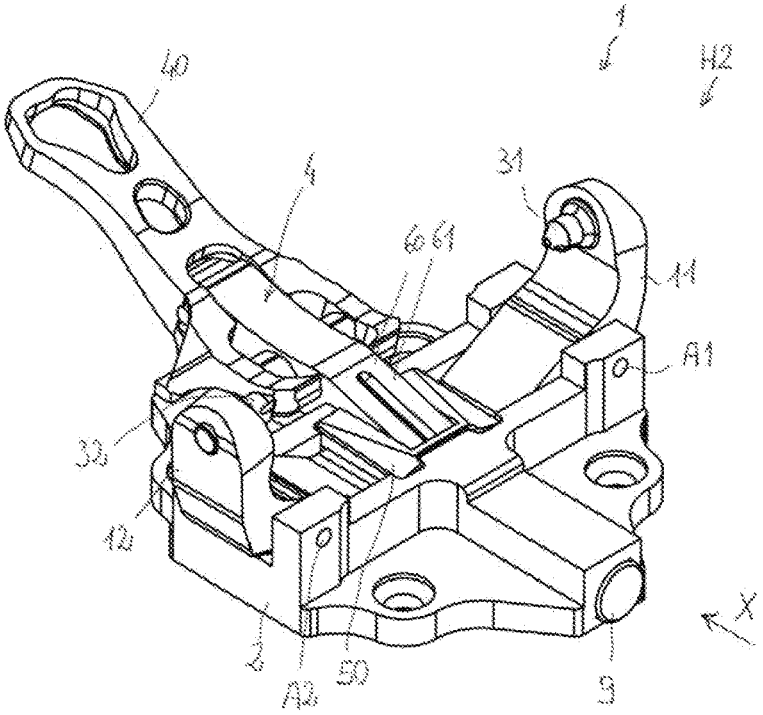
FIG. 7 is a perspective view of the toe-piece of the ski binding of FIG. 1, in a ski descent configuration, which enables the skier to ski downhill.

The first guide (21) preferably extends linearly in the first oblique direction (B1), see for example FIG. 6.

The second guide (22) preferably extends linearly in the second oblique direction (B2), see for example FIG. 6.

The second jaw (12) is preferably opposite the first jaw (11).

The first guide (21) and the second guide (22) preferably have, between them, a convergent-divergent profile; this profile is further still more preferably symmetrical with respect to a plane that passes through the longitudinal axis of the ski (C) when the base (2) is fixed to the ski. See for example FIG. 6.

The activating lever (4) is preferably rotatable with respect to a third axis of rotation (A3) (FIGS. 1, 3 for example) which is perpendicular to the longitudinal axis of the ski (C) when the base (2) is fixed to the ski.

The activating lever (4) is preferably provided with a fork element (60) comprising a first prong (61) and a second prong (62).

The second prong (62) is preferably arranged between the joint (5) and the ski when the base (2) is fixed to the ski.

The joint (5) is preferably arranged between the first prong (61) and the second prong (62) of the activating lever (4).

The joint (5) is preferably wedge-shaped.

The first sliding element (51) and the second sliding element (52) preferably have together a convergent-divergent profile; further, this profile is still more preferably symmetrical with respect to a plane that passes through the longitudinal axis of the ski (C) when the base (2) is fixed to the ski.

The joint (5) is preferably in a single body.

The activating lever (4) can be activatable by the user to unhook the ski boot (3) from the toe-piece of the ski binding (1).

The activating lever (4) is preferably arranged along the longitudinal axis of the ski (C) when the base (2) is fixed to the ski. Still more preferably, the activating lever (4) is arranged symmetrically with respect to the plane that passes through the longitudinal axis of the ski (C).

The housing (6) is preferably solidly constrained to the base (2). Still more preferably, the housing (6) is an integral part the base (2).

The housing (6) preferably functions as a guide for the elastic means (7).

The housing (6) preferably comprises an elongate chamber (8) for receiving the elastic means (7).

The housing (6) is preferably orientated parallel to the longitudinal axis of the ski (C) when the base (2) is fixed to the ski. Still more preferably, the axis of the housing (6) coincides with the longitudinal axis of the ski (C) when the base (2) is fixed to the ski.

The elastic means (7) preferably comprise a compression spring.

The toe-piece of the ski binding (1) preferably comprises regulating means of the preload (only schematically represented in the figures) of the elastic means (7).

The regulating means of the preload (9) of the elastic means (7) are preferably borne by the base (2).

The regulating means of the preload (9) of the elastic means (7) are preferably arranged at an end of the chamber (8), to act on the elastic means (7).

The regulating means of the preload (9) of the elastic means (7) can comprise an adjustment screw (not illustrated) for regulating the length of the elastic means (7) internally of the housing (6), and thus the compression force.

The housing (6) is preferably interposed between the first jaw (11) and the second jaw (12), on one side, and the rear part of the ski, on the other side, when the base (2) is fixed to the ski.

The first jaw (11) and the second jaw (12) are preferably interposed between the third axis of rotation (A3) of the activating lever (4) and the housing (6), which enables an optimal distribution of the weights along the longitudinal axis of the ski (C) when the base (2) is fixed to the ski.

The first sliding element (51) and the second sliding element (52) preferably have a diverging trajectory towards the rear part of the ski; the first guide (21) and the second guide (22) have a diverging trajectory towards the rear part of the ski (see for example FIG. 6).

Alternatively (FIGS. 25, 26): the housing (6) can be interposed between the first jaw (11) and the second jaw (12), on one side, and the front part of the ski, on the other side, when the base is fixed to the ski; the first sliding element (51) and the second sliding element (52) can have a converging trajectory towards the rear part of the ski; the first guide (21) and the second guide (22) can also have a converging trajectory towards the rear part of the ski.

Figure 3A:
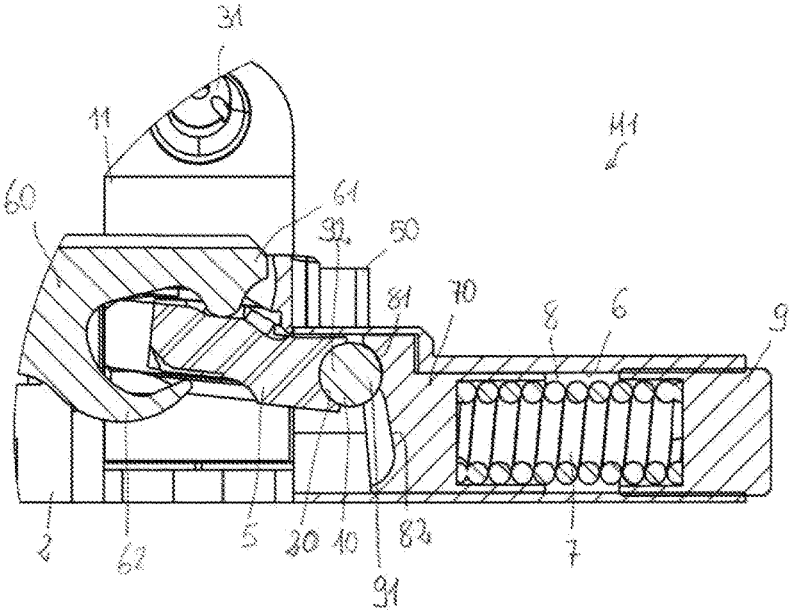
FIG. 3A is a larger-scale view of detail K1 of FIG. 3.
Figure 9A:
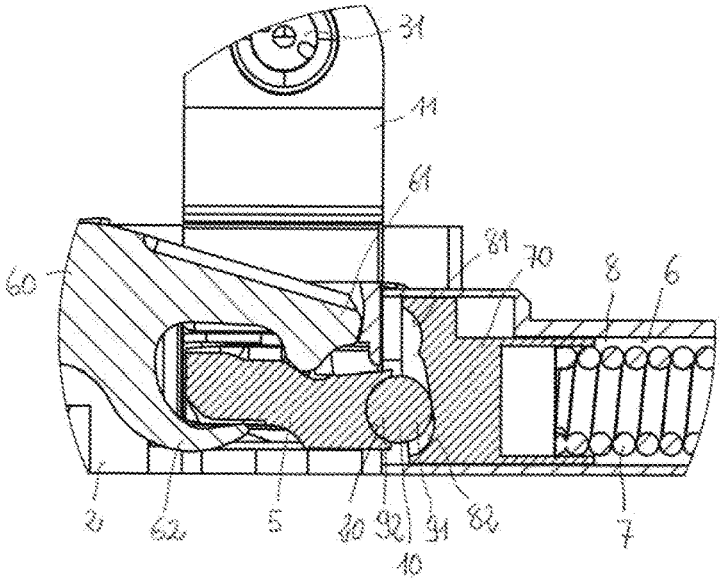
FIG. 9A is a larger-scale view of detail K3 of FIG. 9.
Figure 10A:
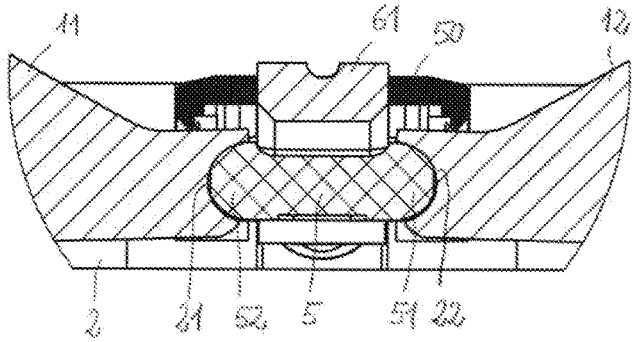
FIG. 10A is a larger-scale view of detail K4 of FIG. 10.
Figure 9:
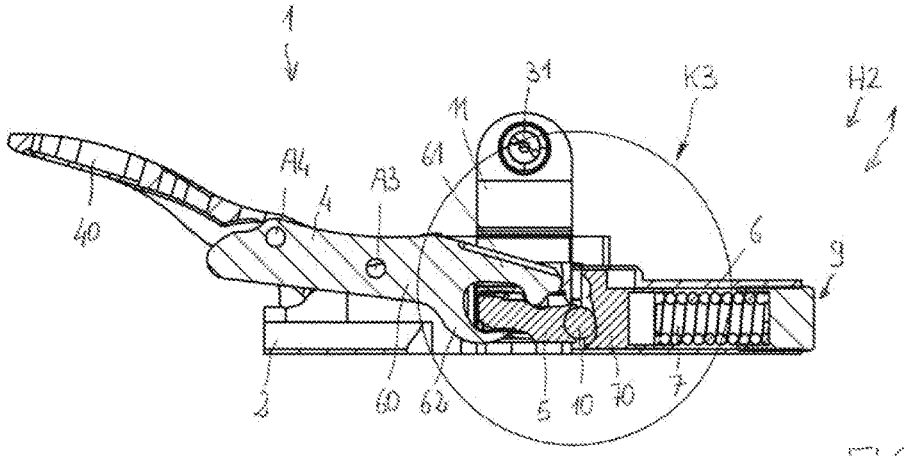
FIG. 9 is a view of section IX-IX of FIG. 8.
Figure 15A:
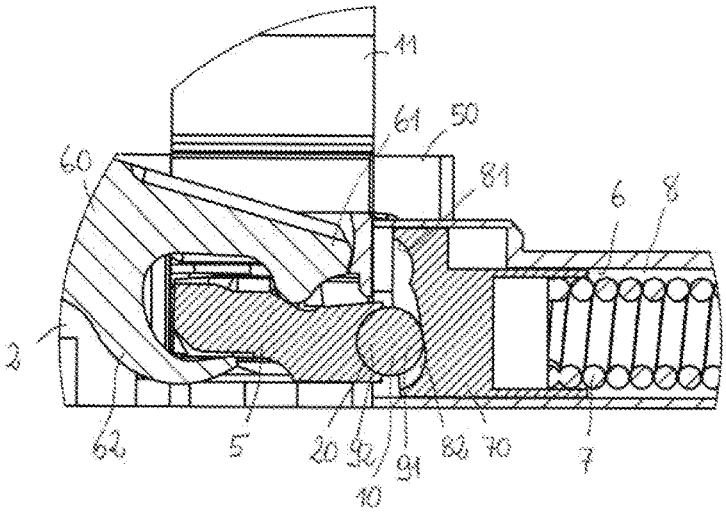
FIG. 15A is a larger-scale view of detail K5 of FIG. 15.
Figure 16A:
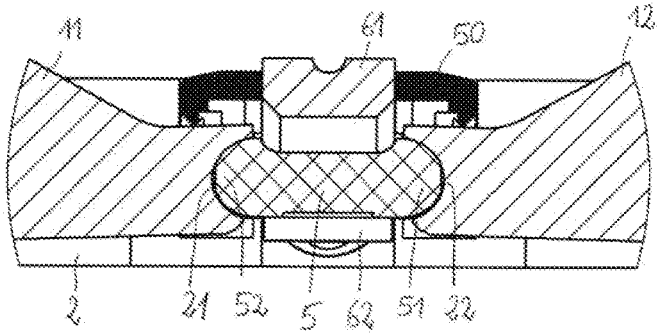
FIG. 16A is a larger-scale view of detail K6 of FIG. 16.
Figure 15:
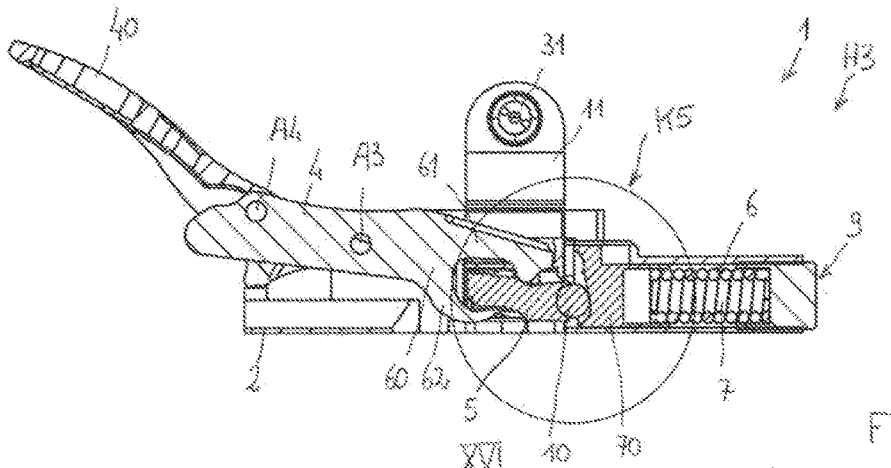
FIG. 15 is a view of section XV-XV of FIG. 14.

The toe-piece of the ski binding (1) preferably comprises a presser (70) (FIGS. 1-21) which is interposed between the joint (5) and the elastic means (7). This is advantageous as the presser (70) can thus be designed to adapt, on one side, to the shape of the elastic means (7), and, on the other side, to the shape of the joint (5) or of an element, for example a sphere (10), (see below) borne by the joint (5). For example, the presser (70) can have a greater transversal extension with respect to the elastic means (7) (see for example FIGS. 3A, 9A and 15A) in all the possible configurations of the toe-piece of a ski binding (1).

The toe-piece of the ski binding (1) can also comprise a blocking lever (40) which is rotatably coupled to the activating lever (4), for example according to a fourth axis of rotation (A4) (FIG. 3 for example) which is parallel to the third axis of rotation (A3). The blocking lever (40) is activatable manually between a blocked position (FIGS. 13-18, 21, 21A, 24, 24A), in which the unhooking of the ski boot (3) from the toe-piece of the ski binding (1) is prevented, and an unblocked position (FIGS. 1-12, 19, 20, 22, 23), in which it is non-active.

Figure 1A:
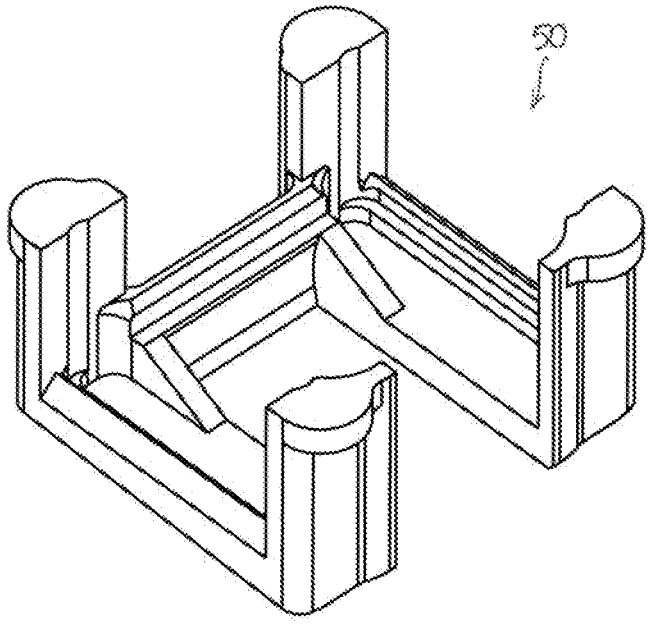
FIGS. 1A and 1B are perspective views of a component of the toe-piece of the ski binding of FIG. 1.
Figure 1B:
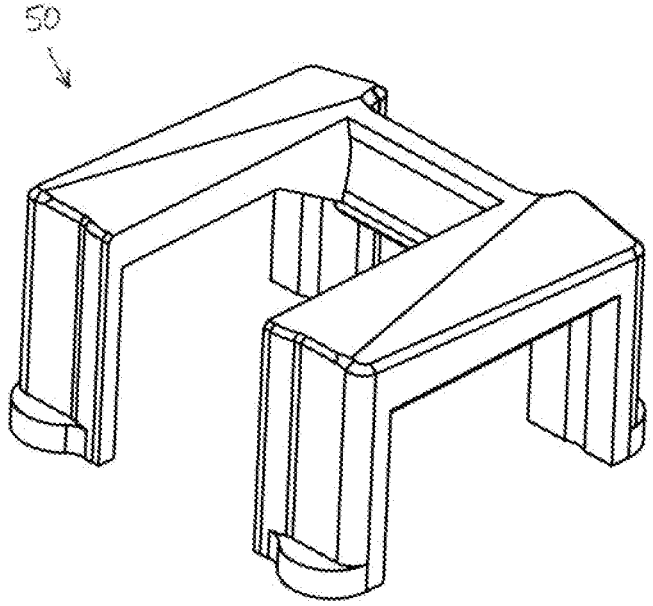

The toe-piece of the ski binding (1) can comprise a cover (50) (FIGS. 1A, 1B) which rests on the base and which joints between the fork element (60), the first jaw (11) at the first guide (61) and the second jaw (12) at the second guide (62), to prevent any snow and/or dirt from reaching the joint (5), the sphere (10), the first presser seat (81) and the second presser seat (82).

According to a first embodiment of the invention, illustrated in figures from 1 to 18, the toe-piece of the ski binding (1) also comprises a sphere (10); the sphere (10) is interposed between the joint (5) and the presser (70); the presser (70) is interposed between the sphere (10) and the elastic means (7); the presser (70) comprises a first presser seat (81) (see for example FIG. 3A) which receives a first portion (91) of the sphere (10), when the toe-piece of the ski binding (1) is in a configuration ready to receive the ski boot (H1) (FIGS. 1-6) wherein the first pin (31) and the second pin (32) are moved away from one another; the presser (70) comprises a second presser seat (82) (see for example FIG. 3A) which is contiguous to the first presser seat (81) and closer to the ski with respect to the first presser seat (81) when the base (2) is fixed to the ski; the second presser seat (82) receives the first portion (91) of the sphere (10), when the toe-piece of the ski binding (1) is in a use configuration (FIGS. 7-18) wherein the first pin (31) and the second pin (32) are moved towards one another and inserted respectively in the first lateral hole (41) and in the second lateral hole (42) of the ski boot (3); the joint (5) comprises a joint seat (20) (5) which receives a second portion (92) of the sphere (10).

The above-mentioned use configuration of the toe-piece of the ski binding (1) can be: a descent configuration (H2), FIGS. 7-12, in which the skier can ski downhill; or a ski ascent configuration (H3), FIGS. 13-18, in which the skier can ski uphill.

The sphere (10) can be made of a different material from the material of which the joint (5) and the presser (70) are realised (for example steel or aluminium if the joint (5) and presser (70) are made of plastic).

The second portion (92) of the sphere (10) can be opposite the first portion (91) of the sphere (10).

According to a second embodiment of the invention, illustrated in figures from 19 to 21, the sphere (10) is absent. The presser (70) comprises a first presser seat (81) which receives a portion of the joint (30), when the toe-piece of the ski binding (1) is in the configuration ready to receive the ski boot (H1) wherein the first pin (31) and the second pin (32) are moved away from one another; the presser (70) comprises a second presser seat (82) which is contiguous to the first presser seat (81) and closer to the ski with respect to the first presser seat (81) when the base (2) is fixed to the ski; the second presser seat (82) receives the portion of the joint (30), when the toe-piece of the ski binding (1) is in a use configuration wherein the first pin (31) and the second pin (32) are moved towards one another and inserted respectively in the first lateral hole (41) and in the second lateral hole (42) of the ski boot (3).

According to a third embodiment of the invention, illustrated in figures from 22 to 24, the presser (70) is absent and the elastic means (7) directly contact the joint (5).

Figure 25:
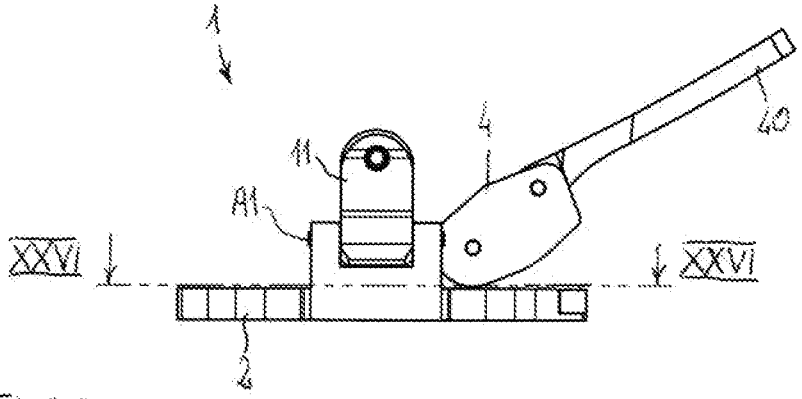
FIG. 25 is a lateral view of a toe-piece of the ski binding for ski mountaineering, object of the present invention, and according to a fourth embodiment, in a configuration ready to receive a ski boot.
Figure 26:
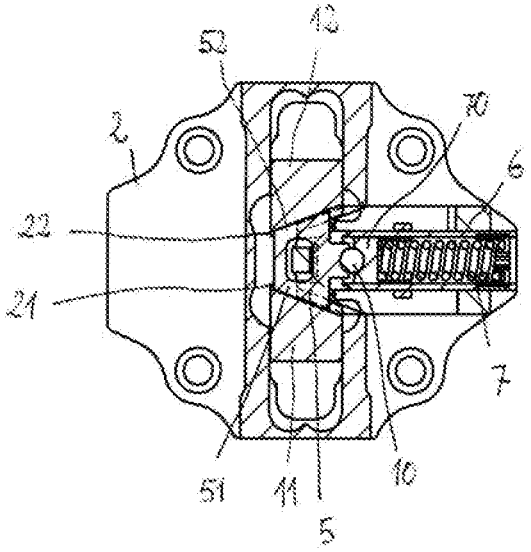
FIG. 26 is a view of section XXVI-XXVI of FIG. 25.

A fourth embodiment is also illustrated, FIGS. 25, 26, which differs from the first embodiment in that: the housing (6) is interposed between the first jaw (11) and the second jaw (12), on one side, and the front part of the ski, on the other side, when the base (2) is fixed to the ski; the first sliding element (51) and the second sliding element (52) have a converging trajectory towards the rear part of the ski; the first guide (21) and the second guide (22) also have a converging trajectory towards the rear part of the ski.

There follows a description of the functioning of the toe-piece of the ski binding (1) according to the first embodiment, FIGS. 1-18.

Figure 3:
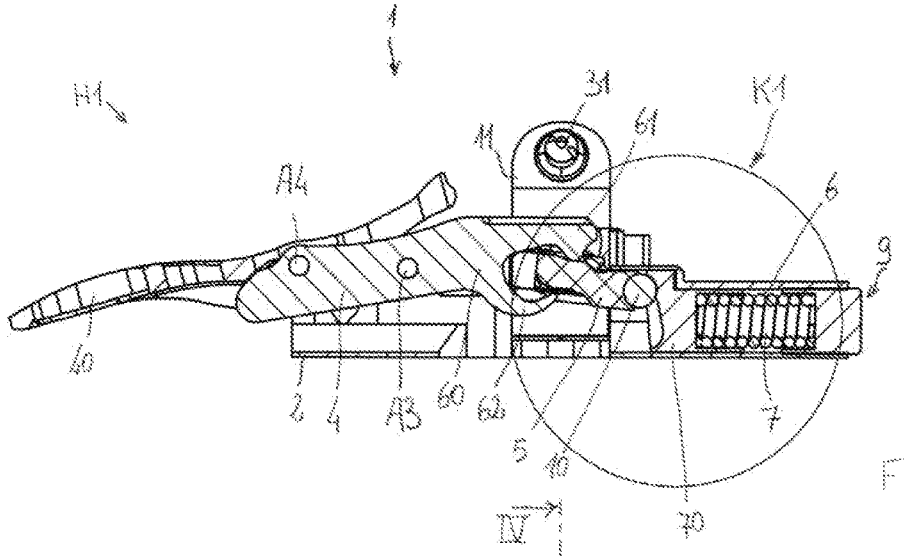
FIG. 3 is a view of section III-III of FIG. 2.

FIGS. 1-6 show the toe-piece of the ski binding (1) in the configuration ready to receive the ski boot (H1), in which the pins are moved away from one another (FIG. 5) in order to allow the tip of the ski boot (3) to be inserted between the pins and press on the activating lever (4). The blocking lever (40) is in the unblocked position. The joint (5) is raised. The elastic means (7) press on the presser (70): the presser (70)

in turn presses, by means of the sphere (10) which is arranged in the first presser seat (81), against the joint (5), which joint (5) remains stably in the raised position, see for example FIG. 3.

To bring the toe-piece of the ski binding (1) into the descent configuration (H2) (FIGS. 7-12), the tip of the ski boot (3) must insert between the pins and press on the activating lever (4) with a sufficient force to lower the joint (5) against the action of the elastic means (7), so that the pins insert in the lateral holes of the tip of the ski boot (3) (FIG. 10), therefore hooking the ski boot (3). Let us compare FIGS. 3 and 9: the activating lever (4) is rotated in a clockwise direction, and the joint (5) is lowered, bringing the sphere (10) into the second presser seat (82) of the presser (70). At this point it is possible to ski downhill. To bring the toe-piece of the ski binding (1) newly into the configuration ready to receive the ski boot, the blocking lever (40) can be designed in such a way that a rotation thereof (in an anti-clockwise direction in FIG. 9) can place on the activating lever (4) a torque that is sufficient for the activating lever (4) to raise the joint (5) against the action of the elastic means (7); alternatively, it is clearly possible to act directly on the activating lever (4), for example with the tip of a ski stick (not illustrated).

To bring the toe-piece of the ski binding (1) into the ascent configuration (H3) (FIGS. 13-18) starting from the descent configuration (H2), it is sufficient to bring the blocking lever (40) into the blocked position. To return the toe-piece of the ski binding (1) into the descent configuration (H2), it is sufficient to newly bring the blocking lever (40) into the unblocked position.

Figure 19:
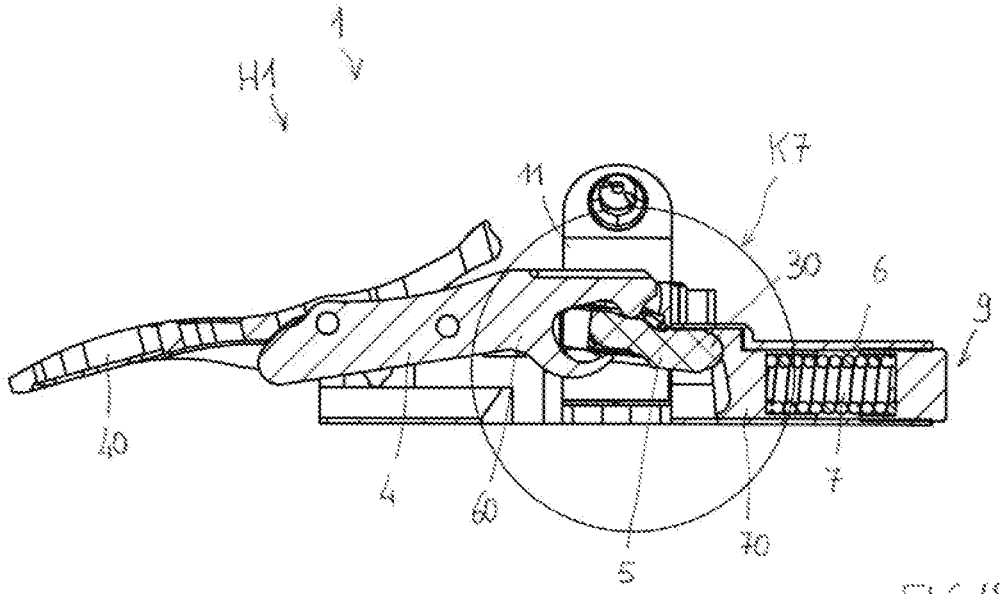
FIG. 19 is a view corresponding to that of FIG. 3, in which the toe-piece of the ski binding is in a configuration ready to receive the ski boot, but relative to a second embodiment of the invention.
Figure 19A:
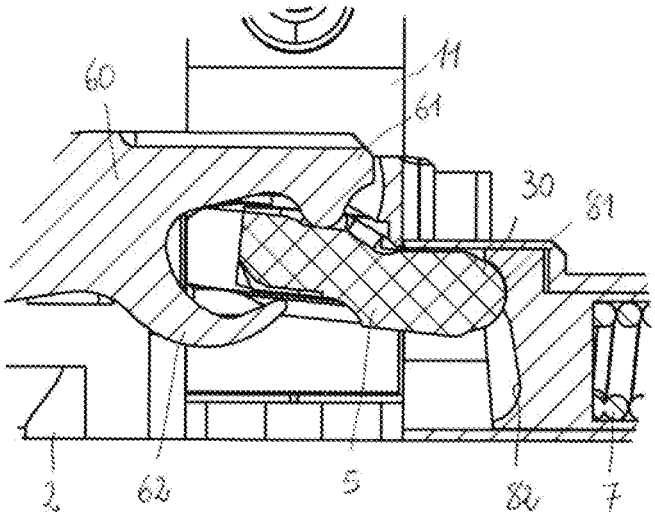
FIG. 19A is a larger-scale view of detail K7 of FIG. 19.
Figure 20:
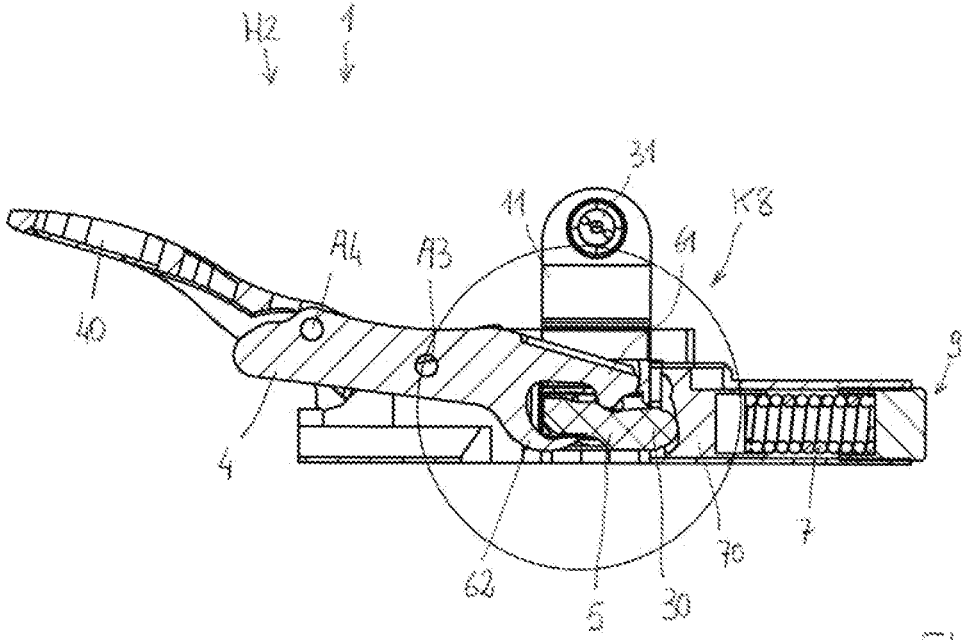
FIG. 20 is a view corresponding to that of FIG. 9, in which the toe-piece of the ski binding is in a descent configuration, but relative to a second embodiment of the invention.
Figure 20A:
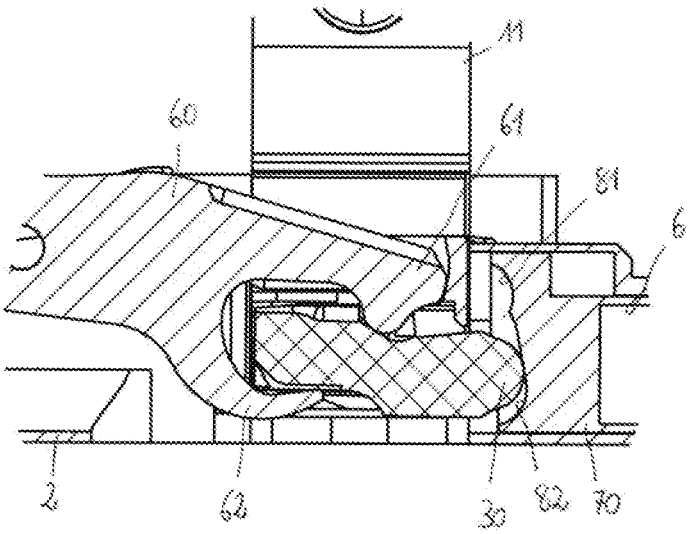
FIG. 20A is a larger-scale view of detail K8 of FIG. 20.
Figure 21:
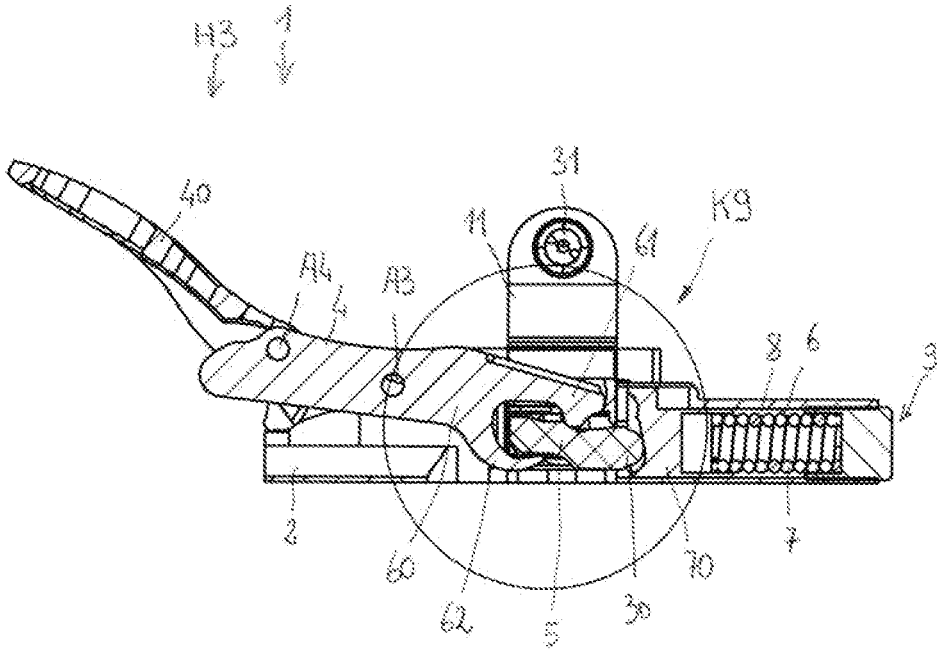
FIG. 21 is a view corresponding to that of FIG. 15, in which the toe-piece of the ski binding is in an ascent configuration, but relative to a second embodiment of the invention.
Figure 21A:
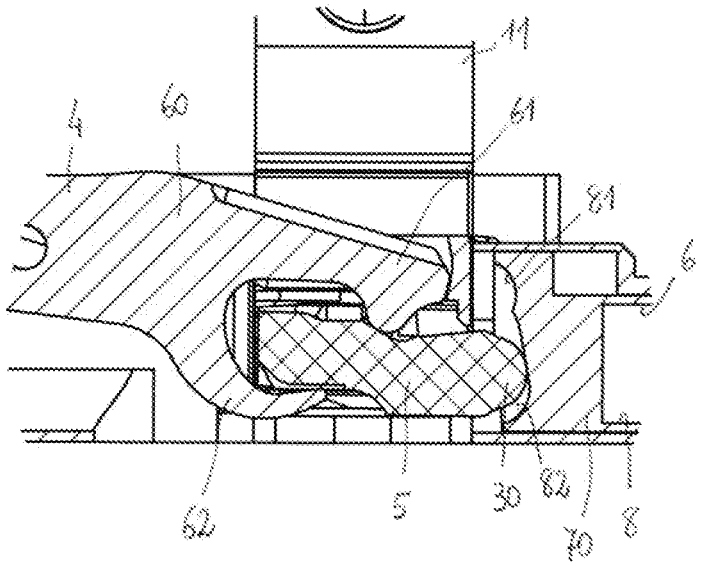
FIG. 21A is a larger-scale view of detail K9 of FIG. 21.

FIGS. 19, 20, 21 illustrate a second embodiment of the toe-piece of the ski binding (1) respectively into the configuration ready to receive the ski boot (3), in the descent configuration (H2) and in the ascent configuration (H3). The second embodiment differs from the first embodiment due to the fact that the sphere (10) is absent, so the joint (5) directly contacts the presser (70); the functioning remains substantially unvaried with respect to the first embodiment.

Figure 22:
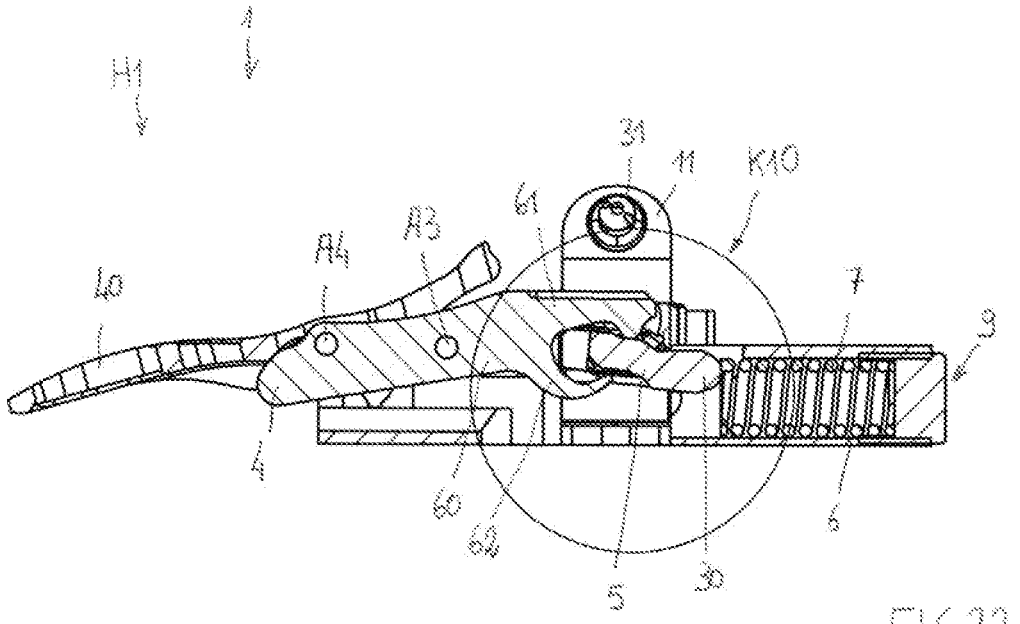
FIG. 22 is a view corresponding to that of FIG. 3, in which the toe-piece of the ski binding is in a configuration ready to receive the ski boot, but relative to a third embodiment of the invention.
Figure 22A:
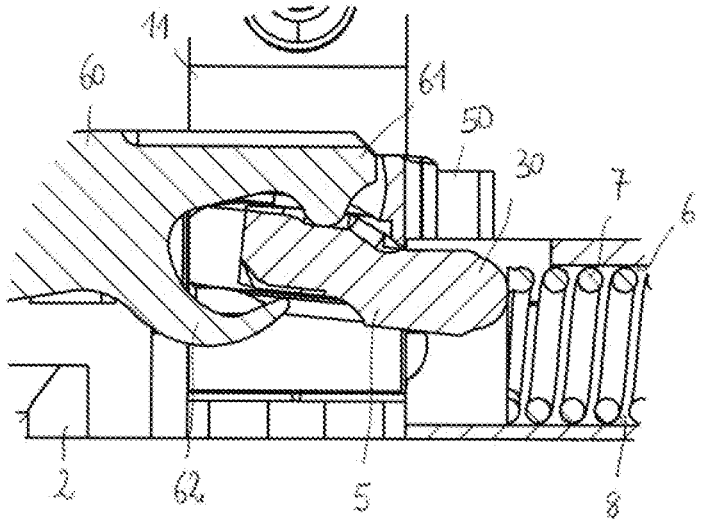
FIG. 22A is a larger-scale view of detail K10 of FIG. 22.
Figure 23:
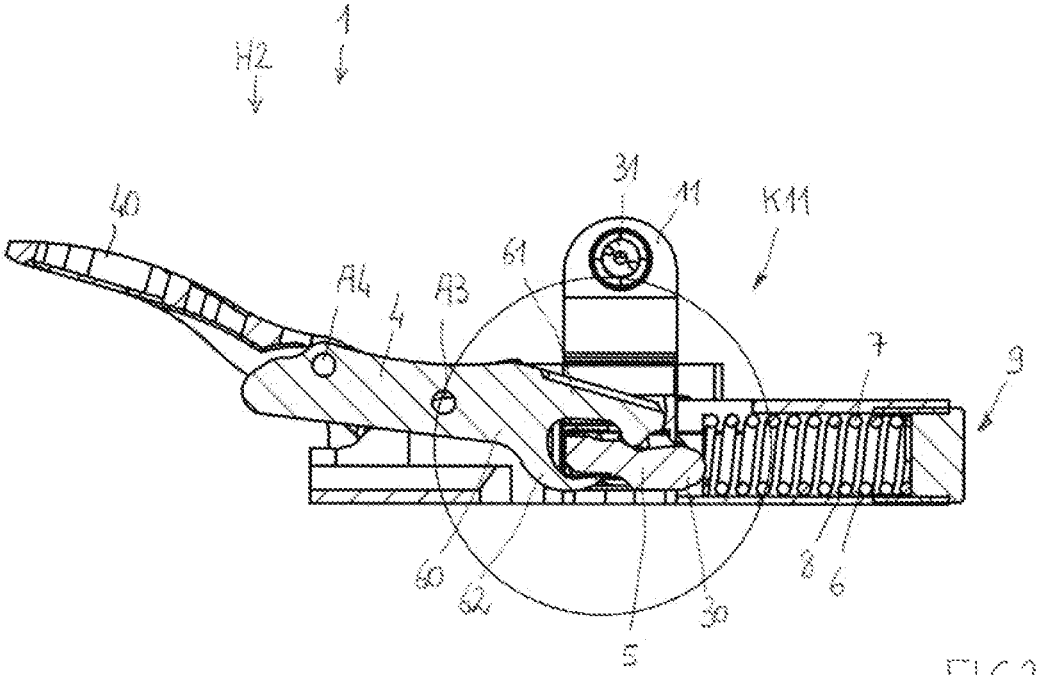
FIG. 23 is a view corresponding to that of FIG. 9, in which the toe-piece of the ski binding is in a descent configuration, but relative to a third embodiment of the invention.
Figure 23A:
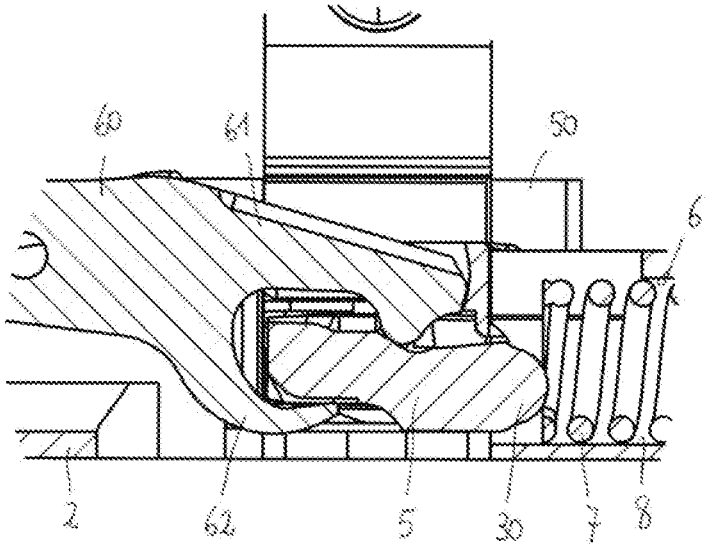
FIG. 23A is a larger-scale view of detail K11 of FIG. 23.
Figure 24:
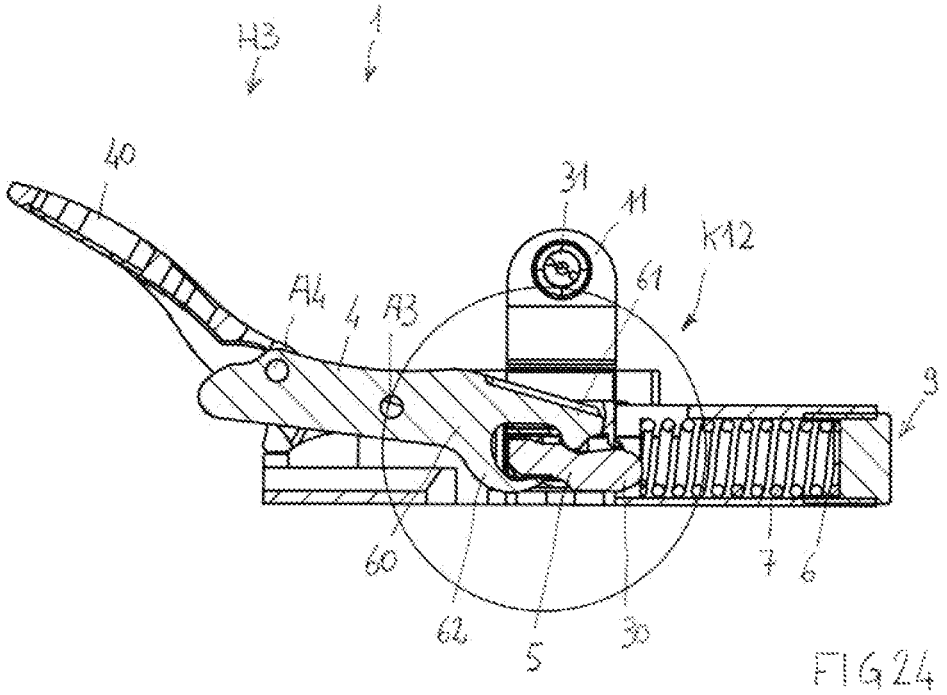
FIG. 24 is a view corresponding to that of FIG. 15, in which the toe-piece of the ski binding is in an ascent configuration, but relative to a third embodiment of the invention.
Figure 24A:
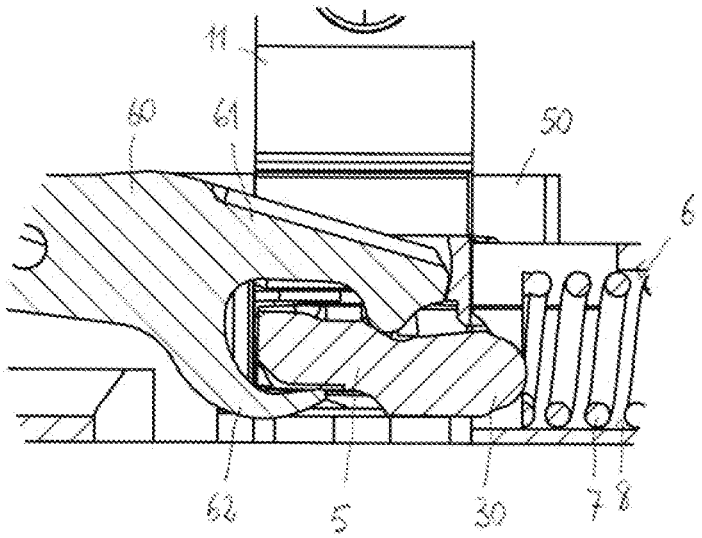
FIG. 24A is a larger-scale view of detail K12 of FIG. 24.

FIGS. 22, 23, 24 illustrate a third embodiment of the toe-piece of the ski binding (1) respectively in the configuration ready to receive the ski boot (3), in the descent configuration (H2) and in the ascent configuration (H3). The third embodiment differs from the first embodiment due to the fact that the sphere (10) and the presser (70) are absent, so that the joint (5) directly contacts the elastic means (7); the functioning remains substantially unvaried with respect to the first embodiment. Also for the fourth embodiment, FIGS. 25, 26, the functioning remains substantially unchanged with respect to the first embodiment.

It is understood that the above has been described by way of non-limiting example and that any technical-functional variants are considered to fall within the protective scope of the present technical solution, as claimed in the following.

The invention claimed is:

1. A toe-piece of a ski binding for ski mountaineering, comprising:

a base which is fixable to a ski;

a first jaw which rotatably couples with the base with respect to a first axis of rotation, and which is provided with a first guide which extends in a first oblique direction with respect to the first axis of rotation;

a second jaw which rotatably couples with the base with respect to a second axis of rotation and which is provided with a second guide which extends in a second oblique direction with respect to the second axis of rotation;

a first pin which is borne by the first jaw for inserting in a first lateral hole made in a tip of a ski boot;

a second pin which is borne by the second jaw for inserting in a second lateral hole made in the tip of the ski boot;

an activating lever which is rotatably coupled to the base;

a joint which is activatable by the activating lever, which comprises a first sliding element which slidably couples with the first guide and which comprises a second sliding element which slidably couples with the second guide, so that the activation of the activating lever causes, by means of the joint, the rotation of the first jaw and the second jaw;

elastic means which are arranged so as to push the joint to wedge against the first jaw and the second jaw; and a housing borne by the base;

wherein:

the elastic means are arranged in the housing;

the housing is interposed between the first jaw and the second jaw, on one side, and the rear part of the ski, on the other side, when the base is fixed to the ski;

the first sliding element and the second sliding element have a diverging trajectory towards the rear part of the ski; and the first guide and the second guide have a diverging trajectory towards the rear part of the ski.

2. The toe-piece of the ski binding of claim 1, comprising regulating means of a preload of the elastic means.

3. The toe-piece of the ski binding of claim 2, wherein the regulating means of the preload of the elastic means are borne by the base.

4. The toe-piece of the ski binding of claim 1, further comprising a presser interposed between the joint and the elastic means.

5. The toe-piece of the ski binding of claim 4, further comprising a sphere, wherein:

the sphere is interposed between the joint and the presser;

the presser is interposed between the sphere and the elastic means;

the presser comprises a first presser seat which receives a first portion of the sphere, when the toe-piece of the ski binding is in a configuration ready to receive the ski boot wherein the first pin and the second pin are moved away from one another;

the presser comprises a second presser seat which is contiguous to the first presser seat and closer to the ski with respect to the first presser seat when the base is fixed to the ski;

the second presser seat receives the first portion of the sphere, when the toe-piece of the ski binding is in a use configuration wherein the first pin and the second pin are moved towards one another and inserted respectively in the first lateral hole and in the second lateral hole of the ski boot; and the joint comprises a joint seat which receives a second portion of the sphere.

6. The toe-piece of a ski binding according to claim 4, wherein:

the presser comprises a first presser seat which receives a portion of the joint, when the toe-piece of the ski binding is in a configuration ready to receive the ski boot wherein the first pin and the second pin are moved away from one another;

the presser comprises a second presser seat which is contiguous to the first presser seat and closer to the ski with respect to the first presser seat when the base is fixed to the ski;

the second presser seat receives the portion of the joint, when the toe-piece of the ski binding is in a use configuration wherein the first pin and the second pin are moved towards one another and inserted respectively in the first lateral hole and in the second lateral hole of the ski boot.

* * * * *